US009765506B2

(12) United States Patent
Meyer

(10) Patent No.: US 9,765,506 B2
(45) Date of Patent: Sep. 19, 2017

(54) SPLASH GUARD SYSTEM

(71) Applicant: Brenda Meyer, Robertsville, MO (US)

(72) Inventor: Brenda Meyer, Robertsville, MO (US)

( * ) Notice: Subject to any disclaimer, the term of this patent is extended or adjusted under 35 U.S.C. 154(b) by 192 days.

(21) Appl. No.: 14/719,682

(22) Filed: May 22, 2015

(65) Prior Publication Data

US 2016/0340883 A1 Nov. 24, 2016

(51) Int. Cl.
*E03D 9/00* (2006.01)
*A47K 17/00* (2006.01)

(52) U.S. Cl.
CPC ..... *E03D 9/00* (2013.01); *A47K 17/00* (2013.01)

(58) Field of Classification Search
CPC ..... E03D 9/00; A47K 17/00
USPC ..... 4/300.3
See application file for complete search history.

(56) References Cited

U.S. PATENT DOCUMENTS

| | | | | |
|---|---|---|---|---|
| 3,193,845 | A | 7/1965 | Funk | |
| 3,931,649 | A * | 1/1976 | Jankowski | A47K 17/00 4/300.3 |
| 5,373,589 | A | 12/1994 | Rego | |
| 5,564,135 | A | 10/1996 | Jones et al. | |
| D384,139 | S | 9/1997 | Tribolet | |
| 6,119,282 | A | 9/2000 | Serbin | |
| 7,412,732 | B1 | 8/2008 | Leonard | |
| 7,921,478 | B1 | 4/2011 | Vanini | |

* cited by examiner

*Primary Examiner* — Tuan N Nguyen

(57) ABSTRACT

A splash guard system for includes a toilet that has a bowl and a seat. A guard is positioned within the bowl. A plurality of mounts is provided and each of the mounts is attached to the guard. A plurality of retainers is provided and each of the retainers is attached to an associated one of the mounts. Each of the retainers engages the bowl to retain the guard within the bowl.

9 Claims, 5 Drawing Sheets

SPLASH GUARD SYSTEM

BACKGROUND OF THE DISCLOSURE

Field of the Disclosure

The disclosure relates to splash guard devices and more particularly pertains to a new splash guard device for inhibiting urine from being splashed outwardly from a toilet.

SUMMARY OF THE DISCLOSURE

An embodiment of the disclosure meets the needs presented above by generally comprising a toilet that has a bowl and a seat. A guard is positioned within the bowl. A plurality of mounts is provided and each of the mounts is attached to the guard. A plurality of retainers is provided and each of the retainers is attached to an associated one of the mounts. Each of the retainers engages the bowl to retain the guard within the bowl.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
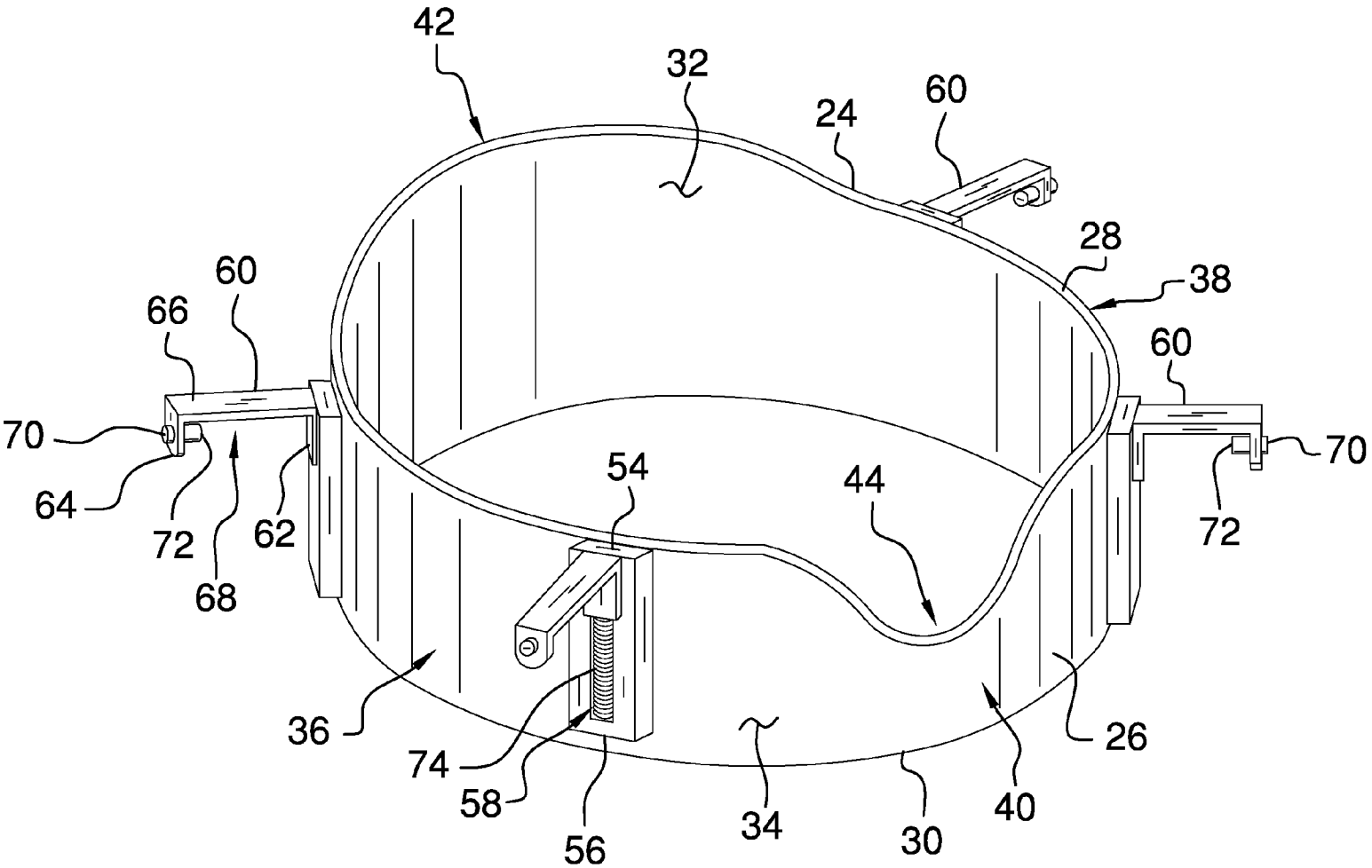
FIG. 1 is a top perspective view of a splash guard system according to an embodiment of the disclosure.
Figure 2:
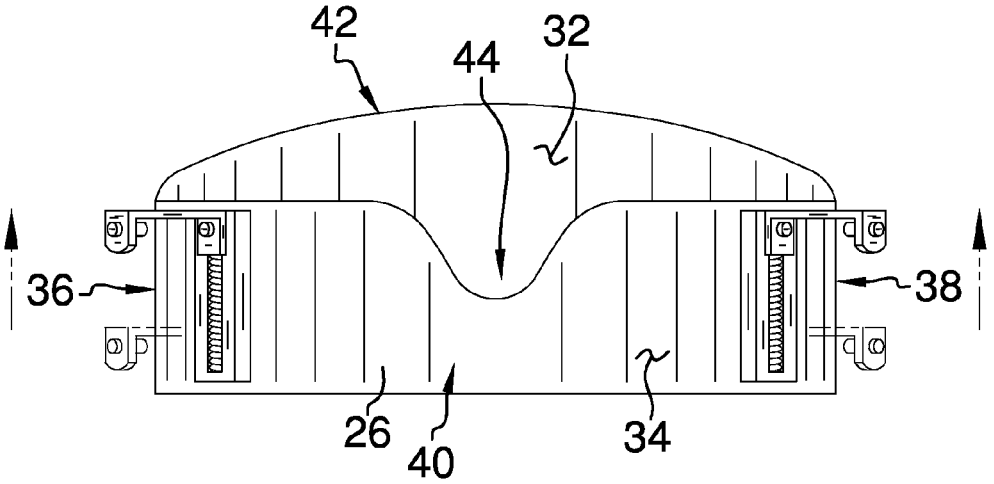
FIG. 2 is a front view of an embodiment of the disclosure.
Figure 3:
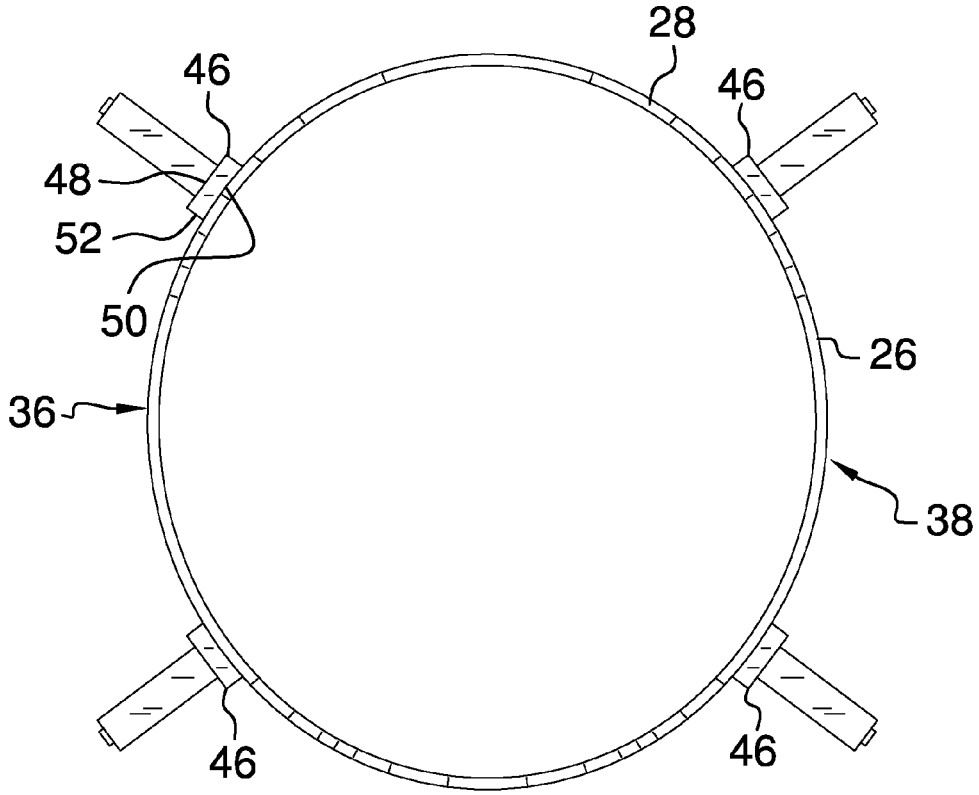
FIG. 3 is a top view of an embodiment of the disclosure.
Figure 4:
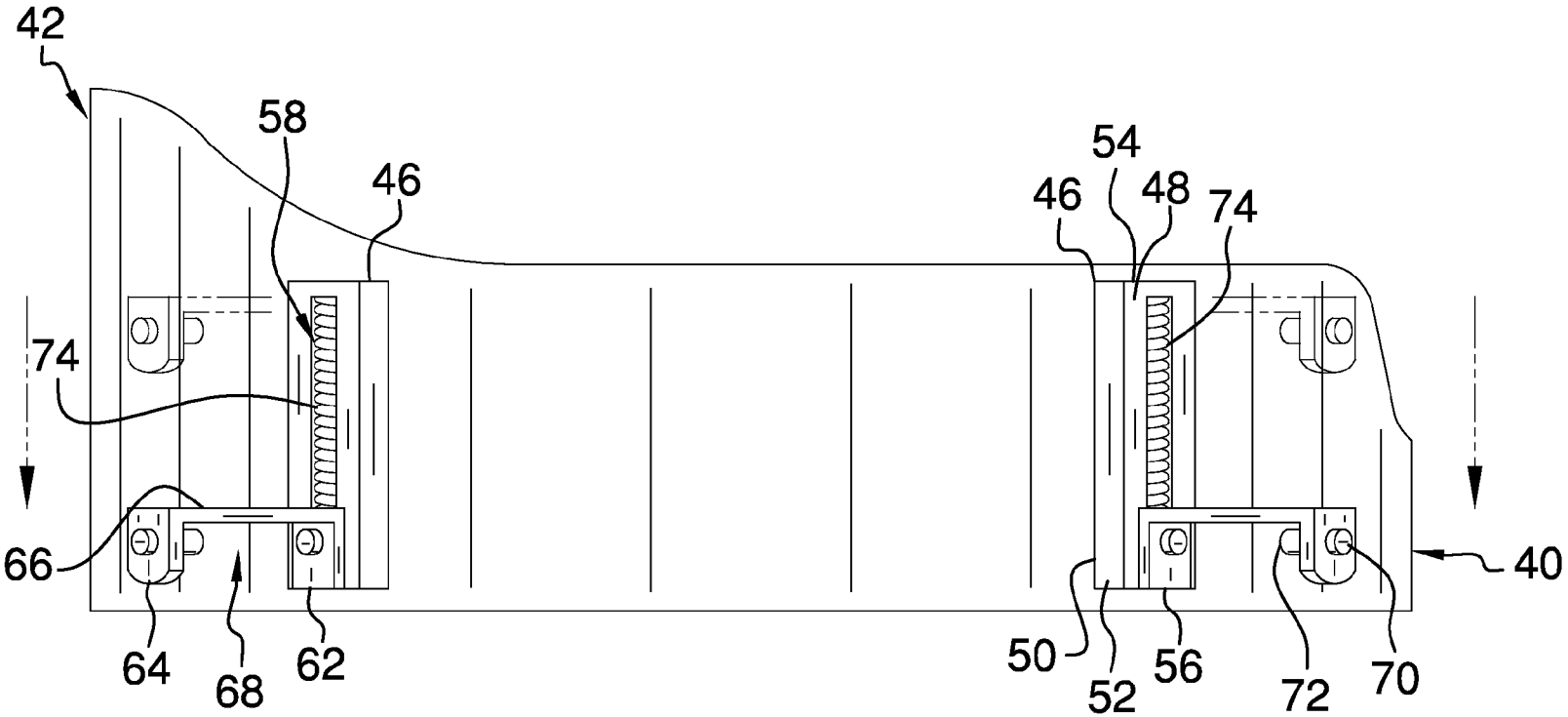
FIG. 4 is a right side view of an embodiment of the disclosure.
Figure 5:
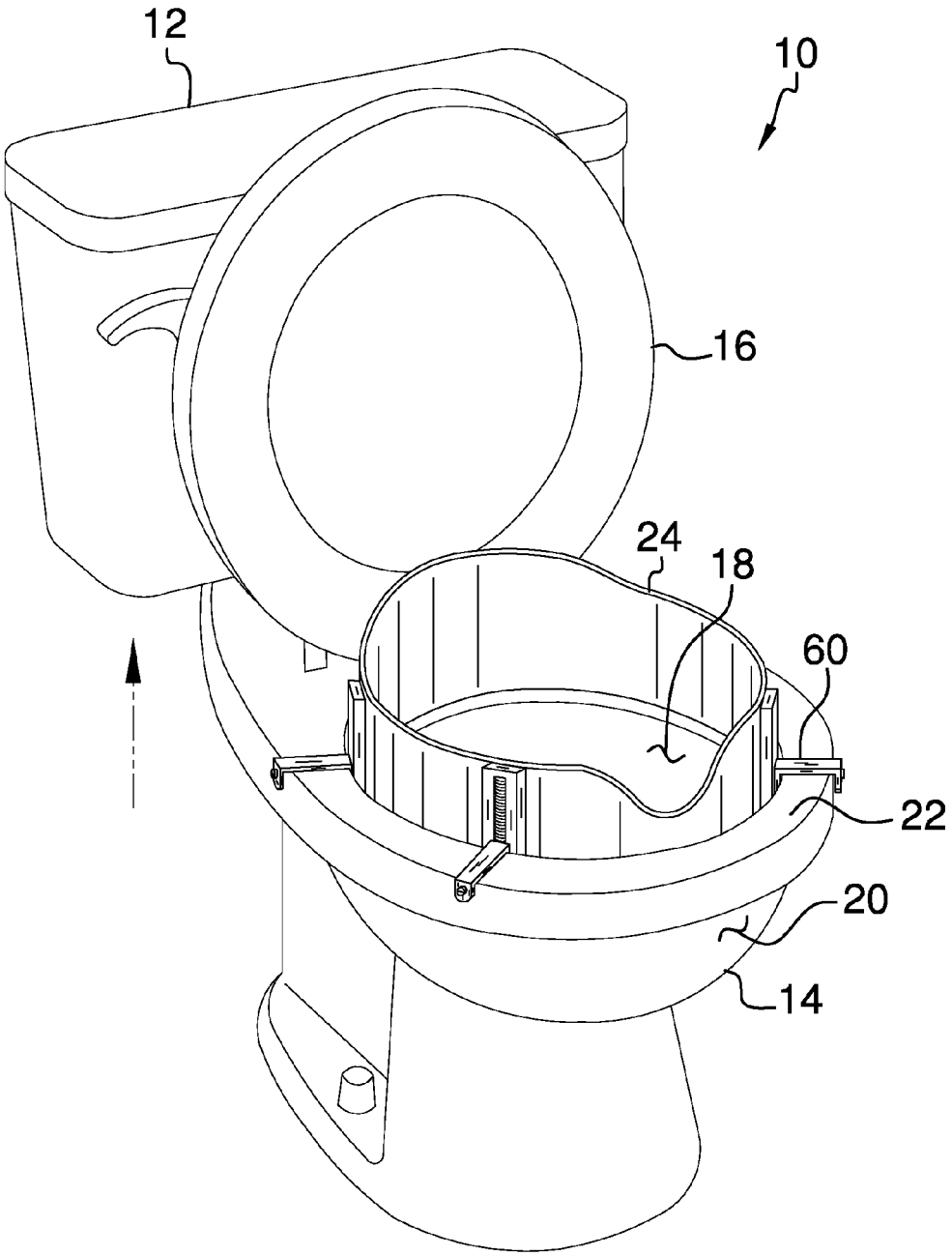
FIG. 5 is a perspective in-use view of an embodiment of the disclosure in a raised position.
Figure 6:
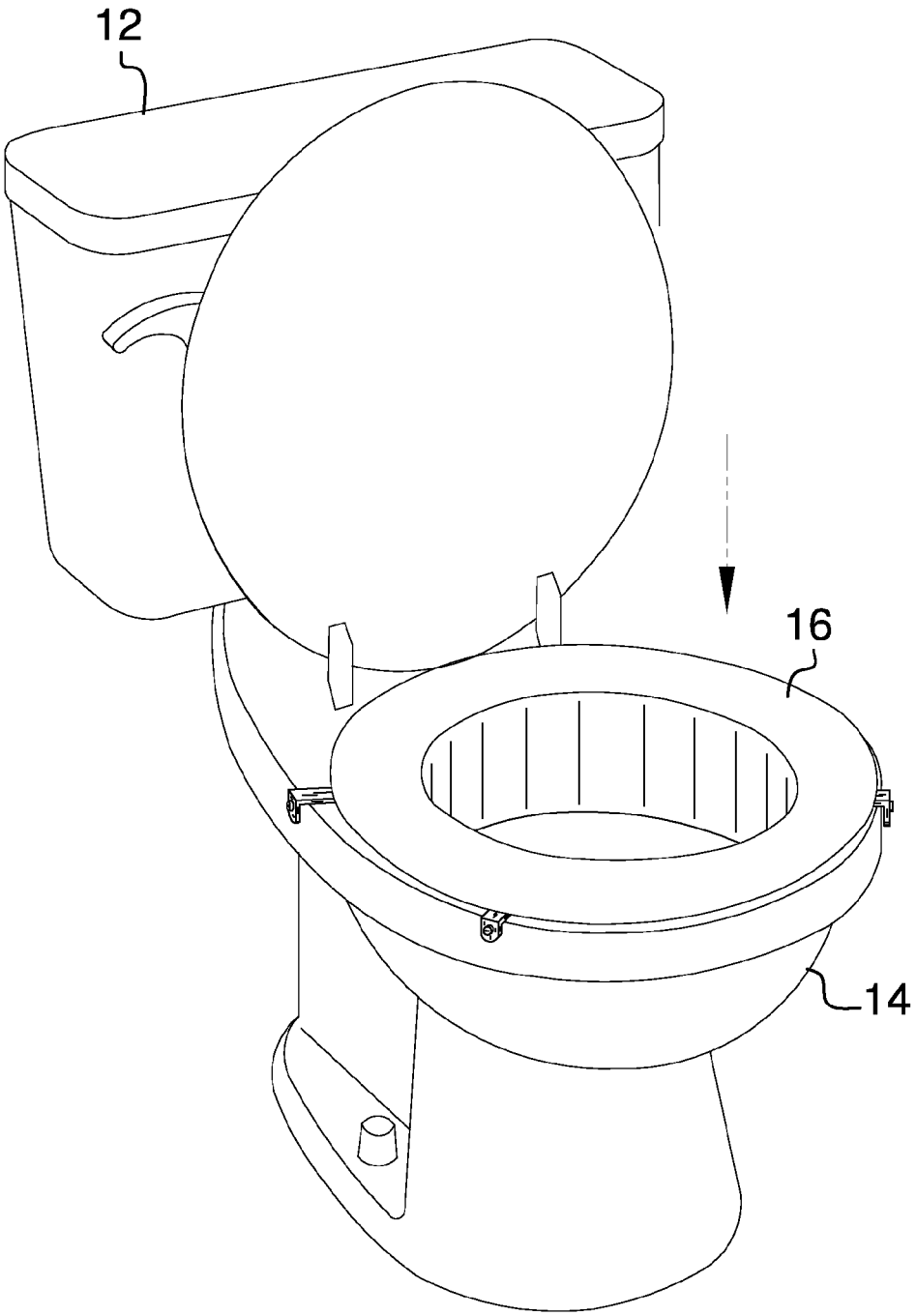
FIG. 6 is a perspective in-use view of an embodiment of the disclosure in a lowered position.

With reference now to the drawings, and in particular to FIGS. 1 through 6 thereof, a new splash guard device embodying the principles and concepts of an embodiment of the disclosure and generally designated by the reference numeral 10 will be described.

As best illustrated in FIGS. 1 through 6, the splash guard system 10 generally comprises a toilet 12 that has a bowl 14 and a seat 16. The bowl 14 has an inner bounding surface 18, an outer bounding surface 20 and an upper edge 22 and the seat 16 is hingedly coupled to the bowl 14. The seat 16 is positioned in a raised position having the seat 16 being spaced from the upper edge 22 and the seat 16 is positioned in a lowered position having the seat 16 abutting the upper edge 22. The toilet 12 may be toilet of any conventional design.

A guard 24 is provided that includes a perimeter wall 26 and the perimeter wall 26 has a top edge 28 and a bottom edge 30. The perimeter wall 26 has an inner surface 32 and an outer surface 34 and each of the inner surface 32 and the outer surface 34 extends between the top edge 28 of the guard 24 and the bottom edge 30 of the guard 24. The perimeter wall 26 is continuous such that the guard 24 forms a closed ring and the perimeter wall 26 has a first lateral portion 36 and a second lateral portion 38. Each of the first lateral portion 36 and the second lateral portion 38 is positioned between a front portion 40 of the perimeter wall 26 and a back portion 42 of the perimeter wall 26.

The top edge 28 of the guard 24 curves downwardly toward the bottom edge 30 to define a groove 44 that is positioned on the front portion 40. The groove 44 has a substantially parabolic shape. The top edge 28 curves upwardly away from the bottom edge 30 on the back portion 42 such that the back portion 42 has a height that is greater than each of the first lateral portion 36 and the second lateral portion 38. The guard 24 is positioned within the bowl 14 having the outer surface 34 being positioned proximate to and being coextensive with the inner bounding surface 18.

A plurality of mounts 46 is provided and each of the mounts 46 has a front wall 48, a back wall 50 and a peripheral wall 52 extending between the front wall 48 and the back wall 50. The peripheral wall 52 of each of the mounts 46 has a top side 54 and a bottom side 56 and the back wall 50 of each of the mounts 46 is attached to the outer surface 34 of the perimeter wall 26. At least one of the mounts 46 is positioned on the first lateral portion 36 and at least one of the mounts 46 is positioned on the second lateral portion 38. The front wall 48 of each of the mounts 46 has a slot 58 extending therethrough and the slot 58 on each of the mounts 46 extends between the top side 54 and the bottom side 56.

A plurality of retainers 60 is provided and each of the retainers 60 has a first arm 62 and a second arm 64 that are each coupled to a central arm 66. The first arm 62 and the second arm 64 are spaced apart from each other to define a bowl space 68 between the first arm 62 and the second arm 64. The bowl space 68 insertably receives the upper edge 22 of the bowl 14 having the first arm 62 being positioned proximate the outer bounding surface 20 and having the second arm 64 being positioned proximate the inner bounding surface 18. The first arm 62 of each of the retainers 60 is slidably attached to on associated one of the mounts 46 and the first arm 62 of each of the retainers 60 is aligned with the slot 58 in the associated mount 46.

A plurality of stops 70 is provided and each of the stops 70 extends through the second arm 64 of an associated one of the retainers 60. Each of the stops 70 has a distal end 72 with respect to the second arm 64 and the distal end 72 is directed toward the first arm 62. The distal end 72 frictionally engages the outer bounding surface 20 of the bowl 14. Each of the stops 70 may be comprised of a resiliently compressible material.

A plurality of biasing members 74 is provided and each of the biasing members 74 is positioned within the slot 58 of an associated one of the mounts 46. Each of the biasing members 74 engages the first arm 62 of an associated one of the retainers 60. Each of the biasing members 74 biases the retainer 60 downwardly on the associated mount 46 such that top edge 28 of the guard 24 is spaced upwardly from the upper edge 22 of the bowl 14 when the seat 16 is positioned in the raised position. Thus, the guard 24 inhibits urine from being splashed outwardly from the bowl 14 when the toilet 12 is utilized by a male for the purposes of urination. The seat 16 engages the top edge 28 of the guard 24 when the seat 16 is positioned in the lowered position such that the top edge 28 of the guard 24 is aligned with the upper edge 22 of the bowl 14.

In use, the guard 24 is positioned within the bowl 14 and each of the retainers 60 is positioned to engage the bowl 14 having the upper edge 22 of the bowl 14 being positioned in the bowl space 68 of each of the retainers 60. The biasing members 74 urge the guard 24 upwardly in the bowl 14 when the seat 16 is positioned in the raised position. Thus, the guard 24 inhibits urine from being splashed outwardly from the bowl 14 when the toilet 12 is utilized by the male for the purposes of urination. The seat 16 urges the guard 24 downwardly in the bowl 14 when the seat 16 is positioned in the lowered position. Thus, the toilet 12 is utilizable by a female for the purposes of urination and defecation and the toilet 12 is utilizable by the male for the purposes of defecation.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A splash guard system configured to inhibit urine from being splashed outwardly from a toilet, said system comprising:

a toilet having a bowl and a seat, said bowl having an upper edge, an inner bounding surface and an outer bounding surface;

a guard being positioned within said bowl;

a plurality of mounts, each of said mounts being attached to said guard;

a plurality of retainers, each of said retainers being attached to an associated one of said mounts, each of said retainers engaging said bowl to retain said guard within said bowl, each of said retainers having a first arm and a second arm each being coupled to a central arm, said first arm and said second arm being spaced from each other to define a bowl space between said first arm and said second arm, said bowl space insertably receiving said upper edge of the bowl having said first arm being positioned proximate said outer bounding surface and having said second arm being positioned proximate said inner bounding surface; and a plurality of stops, each of said stops extending through said second arm of an associated one of said retainers, each of said stops having a distal end with respect to said second arm, said distal end being directed toward said first arm, said distal end frictionally engaging said outer bounding surface.

2. The system according to claim 1, wherein said bowl has an inner bounding surface, an outer bounding surface and an upper edge, said seat being hingedly coupled to said bowl, said seat being positioned in a raised position having said seat being spaced from said upper edge, said seat being positioned in a lowered position having said seat abutting said upper edge.

3. The system according to claim 1, wherein said guard comprises a perimeter wall, said perimeter wall having a top edge and a bottom edge, said perimeter wall having an inner surface and an outer surface, each of said inner surface and said outer surface extending between said top edge of said guard and said bottom edge, said perimeter wall being continuous such that said guard forms a closed ring, said perimeter wall having a first lateral portion and a second lateral portion, each of said first lateral portion and said second lateral portion being positioned between a front portion of said perimeter wall and a back portion of said perimeter wall.

4. The system according to claim 3, wherein said top edge of said guard curves downwardly toward said bottom edge to define a groove being positioned on said front portion, said groove having a substantially parabolic shape, said top edge of said guard curving upwardly away from said bottom edge on said back portion such that said back portion has a height being greater than each of said first lateral portions and said second lateral portion.

5. The system according to claim 1, wherein each of said mounts has a front wall, a back wall and a peripheral wall extending between said front wall and said back wall, said peripheral wall of each of said mounts having a top side and a bottom side.

6. The system according to claim 5, wherein:

said guard includes a perimeter wall, said perimeter wall having an outer surface, a first lateral portion and a second lateral portion; and said back wall of each of said mounts is attached to said outer surface of said perimeter wall, at least one of said mounts being positioned on said first lateral portion, at least one of said mounts being positioned on said second lateral portion, said front wall of each of said mounts having a slot extending therethrough, said slot on each of said mounts extending between said top side and said bottom side.

7. The system according to claim 1, wherein:

each of said mounts has a slot; and said first arm of each of said retainers being slidably attached to on associated one of said mounts, said first arm of each of said retainers being aligned with said slot in said associated mount.

8. The system according to claim 1, further comprising:

said guard having a top edge;

said bowl having a upper edge;

said seat being positioned in a raised position and a lowered position; and a plurality of biasing members, each of said biasing members being positioned within said slot of an associated one of said mounts, each of said biasing members engaging said first arm of an associated one of said retainers, each of said biasing members biasing said retainers downwardly on said associated mount such that top edge of said guard is spaced upwardly from said upper edge of said bowl when said seat is positioned in said raised position wherein said guard is configured to inhibit urine from being splashed outwardly from said bowl, said seat engaging said top edge of said guard when said seat is positioned in said lowered position such that said top edge of said guard is aligned with said upper edge of said bowl.

9. A splash guard system configured to inhibit urine from being splashed outwardly from a toilet, said system comprising:

a toilet having a bowl and a seat, said bowl having an inner bounding surface, an outer bounding surface and an upper edge, said seat being hingedly coupled to said bowl, said seat being positioned in a raised position having said seat being spaced from said upper edge, said seat being positioned in a lowered position having said seat abutting said upper edge;

a guard comprising a perimeter wall, said perimeter wall having a top edge and a bottom edge, said perimeter wall having an inner surface and an outer surface, each of said inner surface and said outer surface extending between said top edge and said bottom edge, said perimeter wall being continuous such that said guard forms a closed ring, said perimeter wall having a first lateral portion and a second lateral portion, each of said first lateral portion and said second lateral portion being positioned between a front portion of said perimeter wall and a back portion of said perimeter wall, said top edge of said guard curving downwardly toward said bottom edge to define a groove being positioned on said front portion, said groove having a substantially parabolic shape, said top edge of said guard curving upwardly away from said bottom edge on said back portion such that said back portion has a height being greater than each of said first lateral portions and said second lateral portion, said guard being positioned within said bowl having said outer surface being positioned proximate to and being coextensive with said inner bounding surface;

a plurality of mounts, each of said mounts having a front wall, a back wall and a peripheral wall extending between said front wall and said back wall, said peripheral wall of each of said mounts having a top side and a bottom side, said back wall of each of said mounts being attached to said outer surface of said perimeter wall, at least one of said mounts being positioned on said first lateral portion, at least one of said mounts being positioned on said second lateral portion, said front wall of each of said mounts having a slot extending therethrough, said slot on each of said mounts extending between said top side and said bottom side;

a plurality of retainers, each of said retainers having a first arm and a second arm each being coupled to a central arm, said first arm and said second arm being spaced from each other apart to define a bowl space between said first arm and said second arm, said bowl space insertably receiving said upper edge of the bowl having said first arm being positioned proximate said outer bounding surface and having said second arm being positioned proximate said inner bounding surface, said first arm of each of said retainers being slidably attached to on associated one of said mounts, said first arm of each of said retainers being aligned with said slot in said associated mount;

a plurality of stops, each of said stops extending through said second arm of an associated one of said retainers, each of said stops having a distal end with respect to said second arm, said distal end being directed toward said first arm, said distal end frictionally engaging said outer bounding surface; and a plurality of biasing members, each of said biasing members being positioned within said slot of an associated one of said mounts, each of said biasing members engaging said first arm of an associated one of said retainers, each of said biasing members biasing said retainers downwardly on said associated mount such that top edge of said guard is spaced upwardly from said upper edge of said bowl when said seat is positioned in said raised position wherein said guard is configured to inhibit urine from being splashed outwardly from said bowl, said seat engaging said top edge of said guard when said seat is positioned in said lowered position such that said top edge of said guard is aligned with said upper edge of said bowl.

* * * * *